United States Patent [19]

Oeth

[11] 4,367,705

[45] Jan. 11, 1983

[54] HEAT ACTIVATED FUEL SHUT-OFF VALVE ACTUATOR

[75] Inventor: James F. Oeth, Dubuque, Iowa

[73] Assignee: Deere & Company, Moline, Ill.

[21] Appl. No.: 259,138

[22] Filed: Apr. 30, 1981

[51] Int. Cl.[3] ..... F02B 37/00

[52] U.S. Cl. ..... 123/198 DB; 123/198 D; 123/198 R

[58] Field of Search ..... 123/198 DB, 198 D, 198 R

[56] References Cited

U.S. PATENT DOCUMENTS 3,523,521 8/1970 Goodwin ..... 123/198 DB
3,620,198 11/1971 Breitschwerdt et al. ..... 123/198 X

FOREIGN PATENT DOCUMENTS 501343 7/1930 Fed. Rep. of Germany ..... 123/198 DB
502967 8/1931 Fed. Rep. of Germany ..... 123/198 DB
573158 3/1933 Fed. Rep. of Germany ..... 123/198 DB
702482 2/1941 Fed. Rep. of Germany ..... 123/198 DB
273560 4/1930 Italy ..... 123/198 DB
1371986 10/1974 United Kingdom ..... 123/198 DB

*Primary Examiner*—Wendell E. Burns

[57] ABSTRACT

An industrial tractor is provided with a fuel system including a fuel tank connected to a fuel pump mounted on the tractor engine. The fuel line includes a section of rubber hose at the end which is connected to the fuel pump while the remainder of the line is metal. A fuel shut-off valve is located in the metal portion of the line. A heat sensitive actuator automatically shifts a spool of the valve from a normal, open position to a closed position in response to being subjected to a relatively high temperature indicative of the existence of a fire in the engine compartment. Thus, fuel in the tank is prevented from feeding the fire in the event that the fire burns through the rubber hose.

2 Claims, 2 Drawing Figures

HEAT ACTIVATED FUEL SHUT-OFF VALVE ACTUATOR

BACKGROUND OF THE INVENTION

The present invention relates to vehicle fuel supply systems and more particularly relates to automatic fuel shut-off devices for such systems.

Vehicles, such as industrial tractors, are commonly equipped with an engine mounted on the vehicle main frame by engine mounts which include resilient vibration isolators which permit the engine to undergo a limited amount of movement relative to the frame. To accommodate this movement, a fuel supply line for connecting a fuel tank of the vehicle to a fuel pump fixed to the engine includes at least a short resilient section, in the form of a rubber hose, extending between the pump and a steel fitting or line that is, in turn, connected to the fuel tank.

Fires which occur on industrial tractors are often located in the engine compartment where combustible materials, such as trash and/or petroleum products have collected and ignited because of the hot environment caused by the engine or where electrical wires have deteriorated and shorted out. These fires, if left to feed on the combustibles available at their onset, would normally burn themselves out and cause only a relatively limited amount of damage. However, instances are known where these relatively minor fires have resulted in the total destruction of a vehicle due to the fact that the fires have burned through the rubber fuel line section, thus permitting many gallons of fuel to escaped to feed, spread and intensify the fire.

SUMMARY OF THE INVENTION

According to the present invention, there is provided an improved vehicle fuel supply system.

An object of the invention is to provide a vehicle fuel system with a shut-off device for automatically operating to prevent fuel contained in the fuel tank from feeding a fire.

A more specific object is to provide a heat sensitive fuel shut-off valve, in the fuel line of a vehicle fuel system, which operates in response to a temperature corresponding to that which would occur during a fire to shut off the flow of fuel from the vehicle fuel tank.

Yet a more specific object is to provide a valve as set forth in the immediately preceding object wherein a heat-expandible element is connected to a valve operator so as to expand and shift a valve spool from an open to a closed position in response to a preselected temperature indicative of the occurrence of a fire, with the connection between the valve operator and the valve spool being a one-way connection so that the valve spool will remain in its closed position after the element contracts and until it is manually reset.

Still another object of the invention is to place the fuel shut-off device, set forth in the objects hereinabove, in the fuel line between the rubber hose and metal conduit or fitting which is, in turn, connected to the fuel tank.

These and other objects will become apparent from a reading of the following description, together with the appended drawings.

DESCRIPTION OF THE PREFERRED EMBODIMENT

Figure 1:
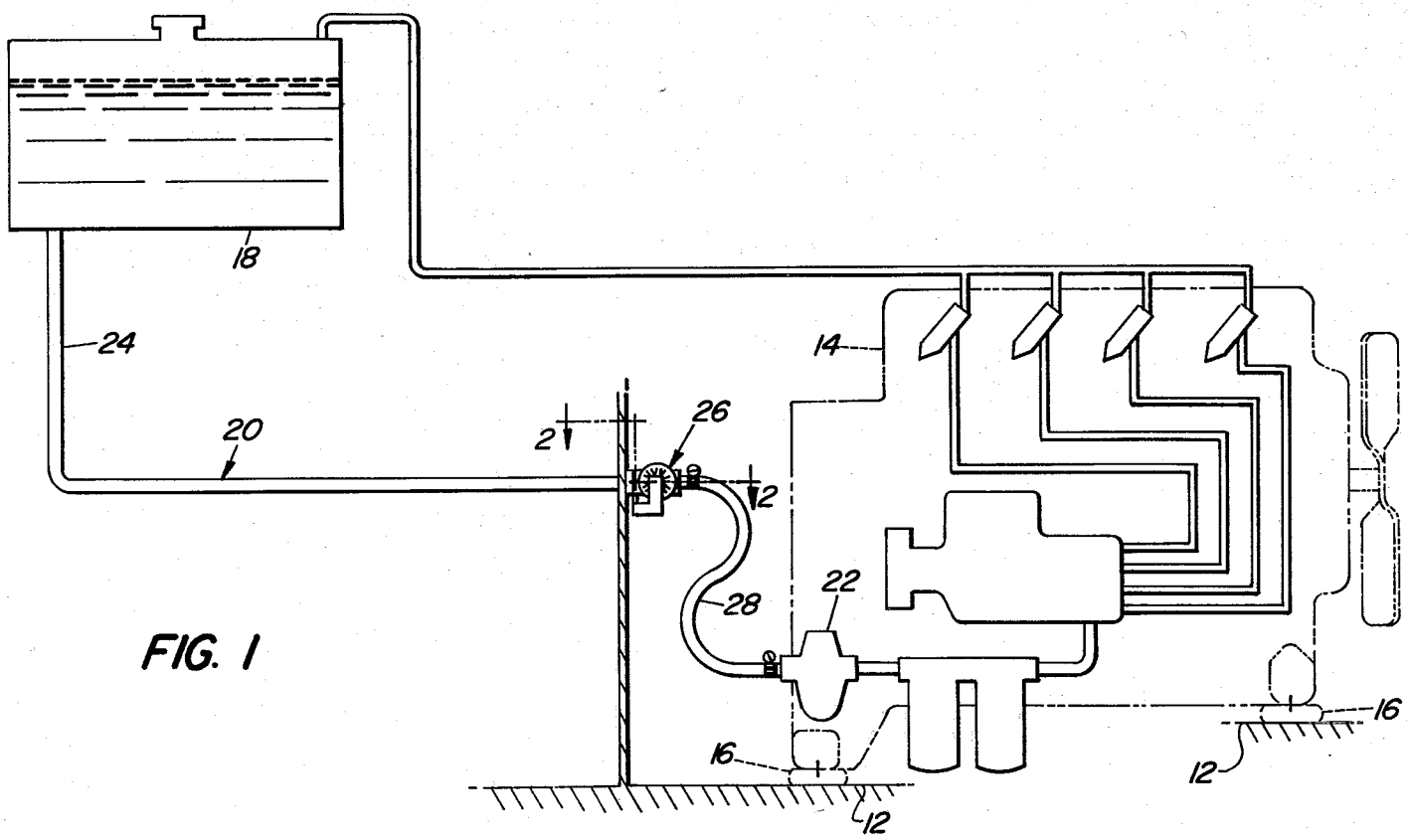
FIG. 1 is a schematic representation of a combined engine and tractor fuel supply system of an industrial tractor constructed in accordance with the present invention.

Referring now to the drawings, therein is shown an industrial vehicle main frame 12 on which an internal combustion engine 14 is mounted by means of a plurality of engine mounts 16 which permit the engine to move relative to the frame. Supported from the frame 12, in any well-known manner, (not shown) is a fuel tank 18. A fuel line 20 is connected between an outlet at the bottom of the tank 18 and a fuel pump 22 mounted on the engine 14. The fuel line 20 includes a steel section 24 connected between the tank 18 and an inlet of a shut-off valve 26 and a flexible section 28 constructed of rubber hose and connected between an outlet of the valve 26 and the pump 22.

Figure 2:
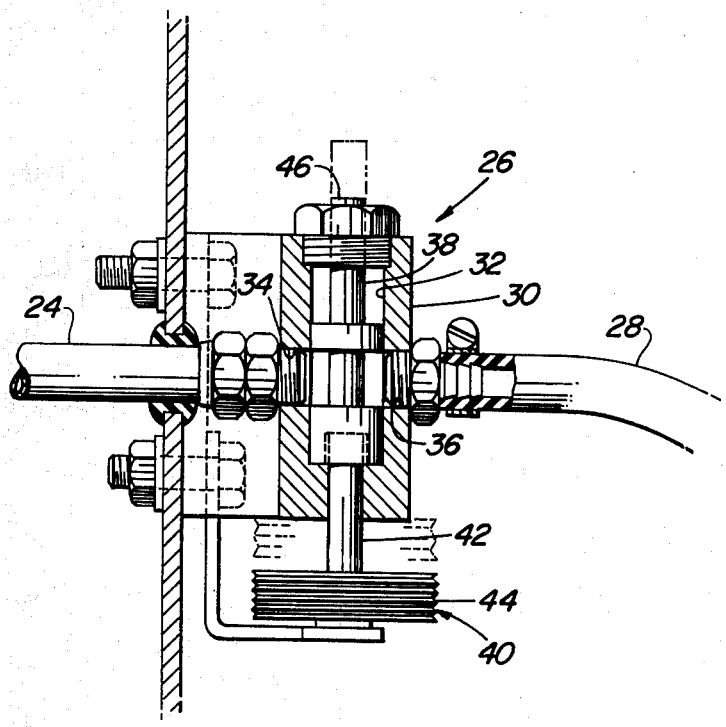
FIG. 2 is an enlarged horizontal sectional view taken along lines 2—2 of FIG. 1 and showing the heat sensitive fuel shut-off valve.

As can best be seen in FIG. 2, the valve 26 includes a valve body 30 defining a valve bore 32 intersected at diametrically opposite locations by inlet and outlet passages 34 and 36, respectively. A valve spool 38 is shiftably mounted in the bore 32 and includes lands located so as to establish a fluid connection between the passages 34 and 36, when the spool is in a normal leftward open position as shown, and so as to block fluid communication between the passages when the spool is in a rightwardly shifted closed position. Provided for shifting the spool 38 rightwardly to its closed position is a heat sensitive valve actuator 40, including a plunger 42 extedning between an inner side of a heat-expandible metal diaphragm 44 and an outer end of the spool 38. When the diaphragm is subjected to a preselected high temperature indicative of a fire existing in the vicinity of the actuator 40, the diaphragm will expand and shift the plunger inwardly which, in turn, shifts the spool inwardly to its closed position. Any suitable heat sensitive actuator may be substituted for the actuator 40.

An extension of the inner end 46 of the spool 38 projects from the housing 30 and is located so that the spool may be manually reset to its open position once the condition which caused the diaphragm 44 to expand has been eliminated and the necessary repairs, if any, have been made.

The operation of the invention is thought clear from the foregoing description and for the sake of brevity, is not reiterated. Suffice it to say that the heat sensitive valve actuator 40 acts to automatically cut off the fuel supply so that a fire which has started in the engine compartment in the vicinity of the rubber hose and, hence, the valve actuator 40, will not be fed fuel from the fuel tank in the event that the hose becomes burned through.

I claim:

1. In a vehicle including an engine, a fuel pump carried by the engine, a fuel tank, and a fuel line connected between the tank and the pump and including at least one section of flexible hose having an end connected to the fuel pump, the improvement of an automatic fuel shut-off device comprising: a valve housing defining a valve bore and inlet and outlet ports leading to spaced locations of the bore, a valve element reciprocably mounted in the bore between the inlet and outlet ports for movement between first and second positions for respectively establishing and preventing fluid communication between the ports, and a heat sensitive actuator connected to the valve element for moving the latter from its first to its second position in response to receiving heat at a temperature indicative of a fire in the vicinity of the controller, and said outlet port being connected to the flexible hose, and metal conduit means connecting the inlet port to the fuel tank.

2. In a vehicle having an engine compartment containing an engine, a fuel pump mounted on the engine, and a fuel line leading from a fuel tank and including a metal section extending from the tank and joined to a flexible section in the form of a rubber hose, the improvement comprising: a fuel shut-off valve means located in the metal section of the fuel line and including a shiftable element movable between a normal, open position permitting fuel to flow to the flexible section and a closed position preventing fuel to flow to the flexible section, and a heat sensitive actuator associated with the shiftable element and operable to automatically shift the shiftable element to its closed position in response to the actuator being subjected to a preselected relatively high temperature which is indicative of the existance of a fire in the engine compartment in the vicinity of the shut-off valve.

* * * * *